United States Patent [19]

Hillegass et al.

[11] Patent Number: 4,922,743

[45] Date of Patent: May 8, 1990

[54] BAR FOR CONNECTING RAILWAY TRACK RAILS AND METHOD OF MAKING SAME

[75] Inventors: Norman W. Hillegass, Homewood, Ill.; Walter J. Drone, Wheatfield, Ind.

[73] Assignee: Track-Work Products, Inc., Chicago, Ill.

[21] Appl. No.: 349,878

[22] Filed: May 9, 1989

Related U.S. Application Data

[63] Continuation of Ser. No. 912,266, Sep. 9, 1986, abandoned.

[51] Int. Cl.[5] ..... B21D 31/06; E01B 11/16

[52] U.S. Cl. ..... 72/377; 72/352; 238/167

[58] Field of Search ..... 238/151, 167, 243; 72/334, 377, 380, 470, 352

[56] References Cited

U.S. PATENT DOCUMENTS

| | | | |
|---|---|---|---|
| 830,847 | 9/1906 | Plimpton | 238/167 |
| 1,333,431 | 3/1920 | McComb | 238/167 |
| 1,446,684 | 2/1923 | Wolhaupter | 238/243 |
| 1,480,437 | 1/1924 | Groff | 238/243 |
| 1,781,433 | 11/1930 | Braine | 238/167 |
| 1,818,880 | 8/1931 | Braine | 72/377 |
| 2,034,045 | 3/1936 | Langford | 72/377 X |
| 2,531,656 | 11/1950 | Thonger | 238/167 |

*Primary Examiner*—Dennis H. Pedder
*Assistant Examiner*—Gary C. Hoge
*Attorney, Agent, or Firm*—Kinzer, Plyer, Dorn, McEachran & Jambor

[57] ABSTRACT

The disclosed connection bar is elongated, adatped to overlap respective adjacent ends of two rails, and the top and bottom portions at each end of the bar have elongated contact faces shaped to cooperate flush against respective surfaces on these rails. A pair of holes is provided in a web portion of the bar, and securing devices may be extended through the holes for clamping the bar against the rails. An elongated reinforcing rib may be formed on the web portion, extended across the bar transverse to and between the enlarged top and bottom portions, and located to line up adjacent the ends of the rails when the bar is secured to the rails. Other reinforcing ribs may also be extended across the web portion, transverse to and between the top and bottom portions; and these other ribs are located outwardly beyond the holes. The bar may be formed by forging a hot billet of forgeable material between a set of dies having faces that complement respectively the rail and remote sides of the intended bar, the dies being moved toward one another at a high relative velocity to strike the interposed billet with a high impact, sufficient after repeated strikes to shape the billet to that intended for the bar including having the rail-engaging contact faces.

16 Claims, 4 Drawing Sheets

34L
16L
36L
35B
33B
9
96L
32B
86
82
84
94
31B
96H
30B
29B
36H
34H
16H
38L
35
68F
33
32
31
30
68G
29
38H
88
90
20F
20G
71F
71G
68
98
97

BAR FOR CONNECTING RAILWAY TRACK RAILS AND METHOD OF MAKING SAME

This is a continuation of co-pending application Ser. No. 06/912,266 filed on Sept. 9, 1986, now abandoned.

BACKGROUND OF THE INVENTION

Railway track consists of two parallel rails, extended in length for seemingly endless runs. The rails are actually formed from comparatively short rail sections, each of thirty nine or eighty feet length (as fabricated by the rail manufacturer) that are laid end-to-end, with the adjacent ends then either being welded or mechanically connected together. The welded joints, between the shorter (39 or 80 foot) rails may be made up in a rail welding plant, to define continuously welded rail sections, each about one-quarter mile in length, that are then carried on a special rail train to the use site, and dropped off end-to-end as needed; or may be made in the field.

Of importance, the two rails of the track must be exactly spaced apart, to the proper guage; the top running surfaces of adjacent rails, across each separate connection, must be accurately aligned; and if mechanically connected together, the rail ends may only be separated across a small gap.

Mechanical connections between the rail ends use special bars, located opposite one another or both the inside (guage side) and outside (field side) of the rails, each overlapping a short length of each rail; and fastening means that extend through aligned holes in the rails and bar operable to clamp the bars tightly against the rails.

The joint bar may have enlarged top and bottom portions connected together by a narrower web; and contact faces intended to cooperate with specific head and base regions of the rails may be formed on these enlarged top and bottom portions. These contact faces would be specifically shaped and orientated to be flush against the intended head and base regions of the rail.

The rails used by railroads throughout the country are different in size, weight, and/or cross section. By way of example, track on main lines are typically made up of heavier rail stock, weighing in the range of 115–152 pounds per three feet (yard) rail length; while track on some secondary lines may use lighter rail stock, in the range of 70–112 pounds per three foot (yard) rail length. These dissimilar rails vary somewhat with respect to any of many dimensions, including the overall size and shape, and the relative location of the rail head and rail base. Consequently, each specific size of rail would need one specific size of connection bar, with its specific contact faces.

For connecting identical rails together, the contact faces on the different ends of the bar are similar to, and axially aligned with, one another; although different bars may be needed for the field and guage sides of each rail, as right-hand and left-hand images. Such bars are simply referred to as "joint bars"; each being sized for a specific rail section, having a specific cross section, length and hole spacing (such as 24 inches for a four holes, 30 inches for five holes, or 36 inches for six holes), to match a particular rail having a particular rail end drilling.

A conventional joint bar is formed by a specialist, by hot rolling steel bar stock to shape, to provide the intended contact faces; and is then cut to length, and hot punched to provide the holes for the fastening means. Such joint bars are fabricated of standard stock steel, having medimum carbon content, such as AISI C1020 or C1030; and are not made of high carbon steels.

For connecting dissimilar rails, the different size or weight, bars more complicated in shape and configuration are needed . . . known as compromise bars. The typical compromise bar may have the contact faces, defined at the opposite ends of the bar, of different configurations and/or axial alignments (offset vertically and/or horizontally). These differences may be slight (measured in thousandths of an inch) and/or significant (measured in tenths or an inch).

A conventional compromise bar is formed from a conventional joint bar sized for the larger of the two rails, with the opposite end and/or both ends then being mechanically reformed to approach the specific spacing and configuration needed for defining both ends of the bar. To do this, joint bar stock, initially at the approximate length of the intended compromise bar, is heated, and is then mechanically pressed between crude dies in a large hydraulic press. The exact intended compromise bar configuration is rarely achieved solely by the compression dies, so that the bar must then be trimmed and machined, to even approach tolerance. The compromise bar must also be heat treated, quenched, and scaled; and thereafter, may even have to be further trimmed and machined.

Conventional compromise bars reformed in this manner appear to have several major drawbacks, being: poor tolerances of, and structural weaknesses that crop up in, such bars; resulting in undue risk of and/or actual failures of such bars.

Thus, compromise bars intended to interconnect two rails of significantly different size or shape, must have one bar end reformed into a much smaller overall configuration, requiring significant repositioning and/or removal of the conventional joint bar material. After such reforming, it is not uncommon to have the bar web at the smaller bar end bowed significantly; and even though attempts may be made to straighten a bowed web in a different hydraulic press, complete straightening seldom can be achieved, while retaining the desired overall shape or size of the compromise bar. Machining the excess material off may produce a condition, that the contact faces are on structure below design thickness. On the other hand, conventional compromise bars intended to interconnect two rails of roughly the same size, may not be accurately reformed by the mechanical compression dies, since the dies are typically too crude and/or too insensitive to establish small differences between the offsets or alignments of, or the contact face configurations at, the opposite bar ends; again requiring machining to approach the desired tolerances.

A compromise bar outside of tolerance, may generate stress concentrations in the components; and/or may cause the rail surfaces at the rail ends to be misaligned, creating an excessive interruption across the rail joint. Such conditions could be dangerous until repaired and could lead to field failure . . . and expensive repair.

The mechanical reforming steps needed to reshape the conventional joint bar to approach the shape of the intended compromise bar, set up residual internal stresses in the reformed compromise bar; even though the bar is hot during the reforming steps, and even though the reformed bar may be subsequently quenched. It has been speculated that the greatest stresses may be generated in the regions that are most reformed; and one such regional typically is between the opposite ends of the bar, adapted to bridge the gap between the rail ends. The joint bar stock reformed to the compromise bar, is available only in medium carbon steels. In order to provide adequate hardness to comply with railroad standards, rapid quenching may be required, and such may make the bar brittle and susceptible to surface stress cracking. These structural drawbacks and stress concentrations may be particularly critical in many geographical locations of possible use in this country, where the joint bar will be exposed to very low temperatures, many degrees below freezing.

Commonly, the conventional joint bars and the conventional compromise bars fail in the region between the two bolt holes that correspond to the first hole spaced in from each rail end; frequently through the bolt hole itself, and frequently where the bar actually bridges the gap between the rail ends.

SUMMARY OF THE INVENTION

This invention relates to bars for mechanically connecting adjacent rail ends together, including joint bars for connecting similar size and weight rails together, and compromise joint bars for connecting dissimilar size and/or weight rails together. The invention specifically provides bars that may be formed with accurate contact faces adapted to cooperate properly with each of the rails of the mechanical connection, whereby such connection will be strong and durable during use, having few in-the-field failures requiring repair.

The disclosed connection bar has an elongated body portion having elongated top, bottom, and connecting web portions, arranged such that the top and bottom portions are adapted to contact the rails adjacent the ends to be joined and the web portion will be then spaced from the rails. The web portion has means defining at least two holes to receive means to connect the bar to each of the rails, and reinforcing rib is formed on the web portion intermediate of said holes.

The reinforcing rib may be formed on the side of the web portion facing the rail; and may be elongated and extended between the top and bottom portions of the bar.

Additional reinforcing ribs may be formed on the bar, located beyond the holes and on the side of the respective adjacent hole remote from the first mentioned rib.

The connection bar may be formed by the method of forging, using a set of two dies that complement respectively the rail and remote sides of the bar, and moving the dies toward one another at a relatively high velocity for striking an interposed hot billet of forging material, with a high impact, that ultimately after several strikes shapes the billet to that intended for the bar, including having contact faces formed thereon that are adapted to cooperate specifically with the rails; hot punching holes in the bar for receiving fastening means for connecting to such rails, and oil quenching the bar.

BRIEF DESCRIPTION OF THE DRAWINGS

FIG. 10 illustrates a schematic view of a forging apparatus showing a set of dies.

FIG. 11 illustrates a plan top view of a bottom die face showing four forging stations.

FIG. 12 illustrates a cut-away cross-sectional, exploded view of a set of dies and a compromise bar as viewed along line 12—12 in FIG. 11.

DETAILED DESCRIPTION OF AN ILLUSTRATED EMBODIMENT

Figures 1, 2, 3, 4, 5:
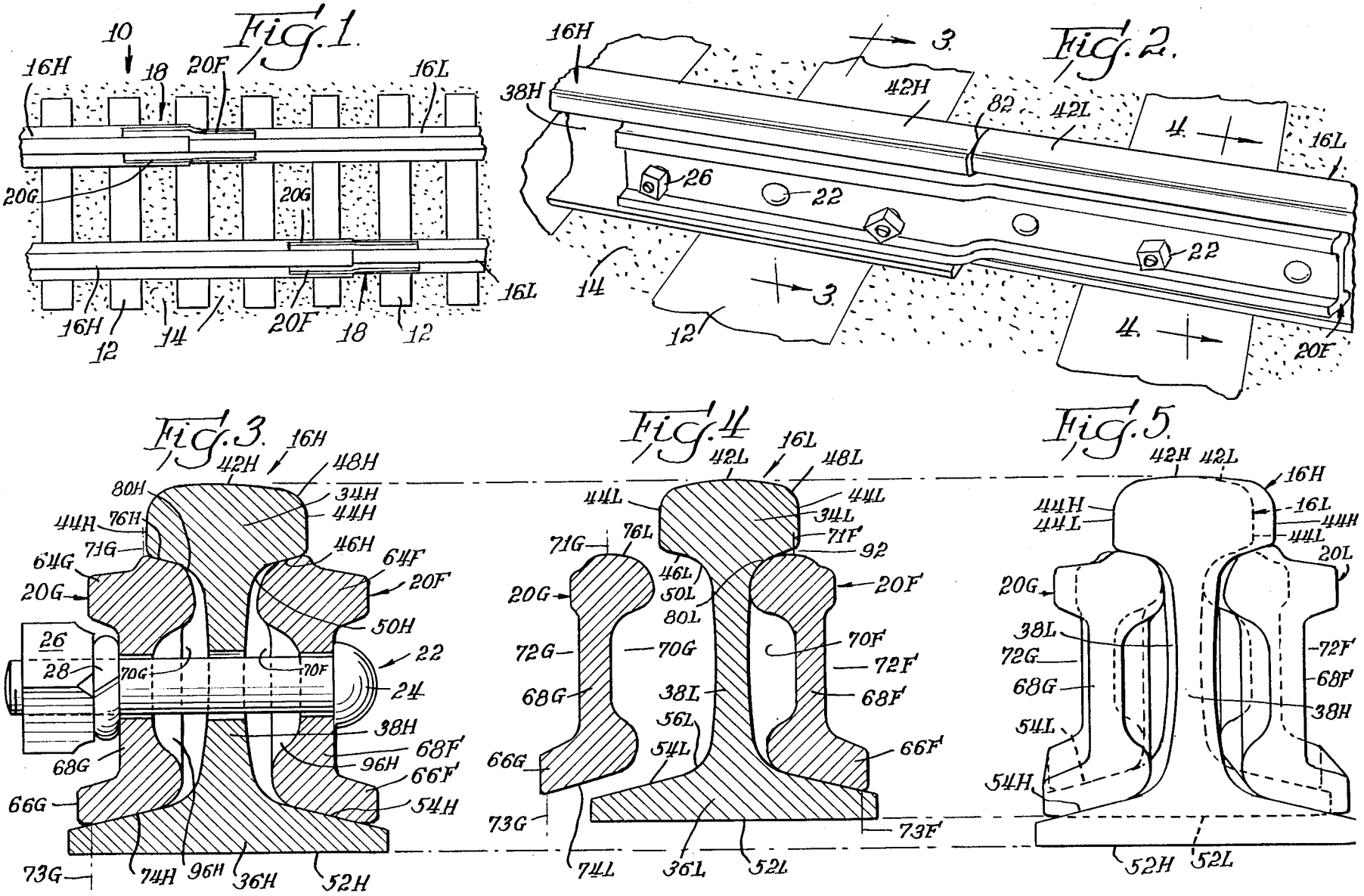
FIG. 1 is a top plan view of a typical railway track having several mechanical connection joints therein, specifically of the compromise bar type.
FIG. 2 is a perspective view of one of the joints from FIG. 1, as seen from the field side of the joint.
FIGS. 3 and 4 are enlarged sectional views of the joint, as taken generally from lines 3—3 and 4—4 in FIG. 2, except one bar of the joint of FIG. 4 is illustrated in a somewhat exploded orientation, for clarity of disclosure.
FIG. 5 is a composite sectional view of the joint, except showing the overall outline and comparative location of the rail surfaces and connection bar contact faces, with the gauge and top running rail surfaces of the rails being aligned.

FIGS. 1 and 2 illustrate a railway track 10 consisting of two parallel rails supported on ties 12 embedded in ballast 14. Each rail of the track 10 is illustrated as being made up of heavier rail 16H and lighter rail 16L, arranged end-to-end and connected together by mechanical joints 18, of the compromise bar type.

Each mechanical joint 18, as illustrated, has a gauge side bar 20G and a field side bar 20F, the bars 20G and 20F being located opposite one another, respectively on the inside and outside of the rails. The bars 20G and 20F are elongated in the direction of the rails and of similar lengths, and overlap a short length of the end of each rail 16H and 16L. Fastening means 22 (see FIGS. 2 and 3) operate to clamp the bars 20F and 20G tightly against the rails 16H and 16L. The fastening means 22 illustrate include headed bolts 24 extended through aligned holes in the rails and bars, nut 26 threaded onto each bolt 24, and spring washer 28 trapped between each nut and the adjacent bar.

Figures 6, 7, 8, 9:
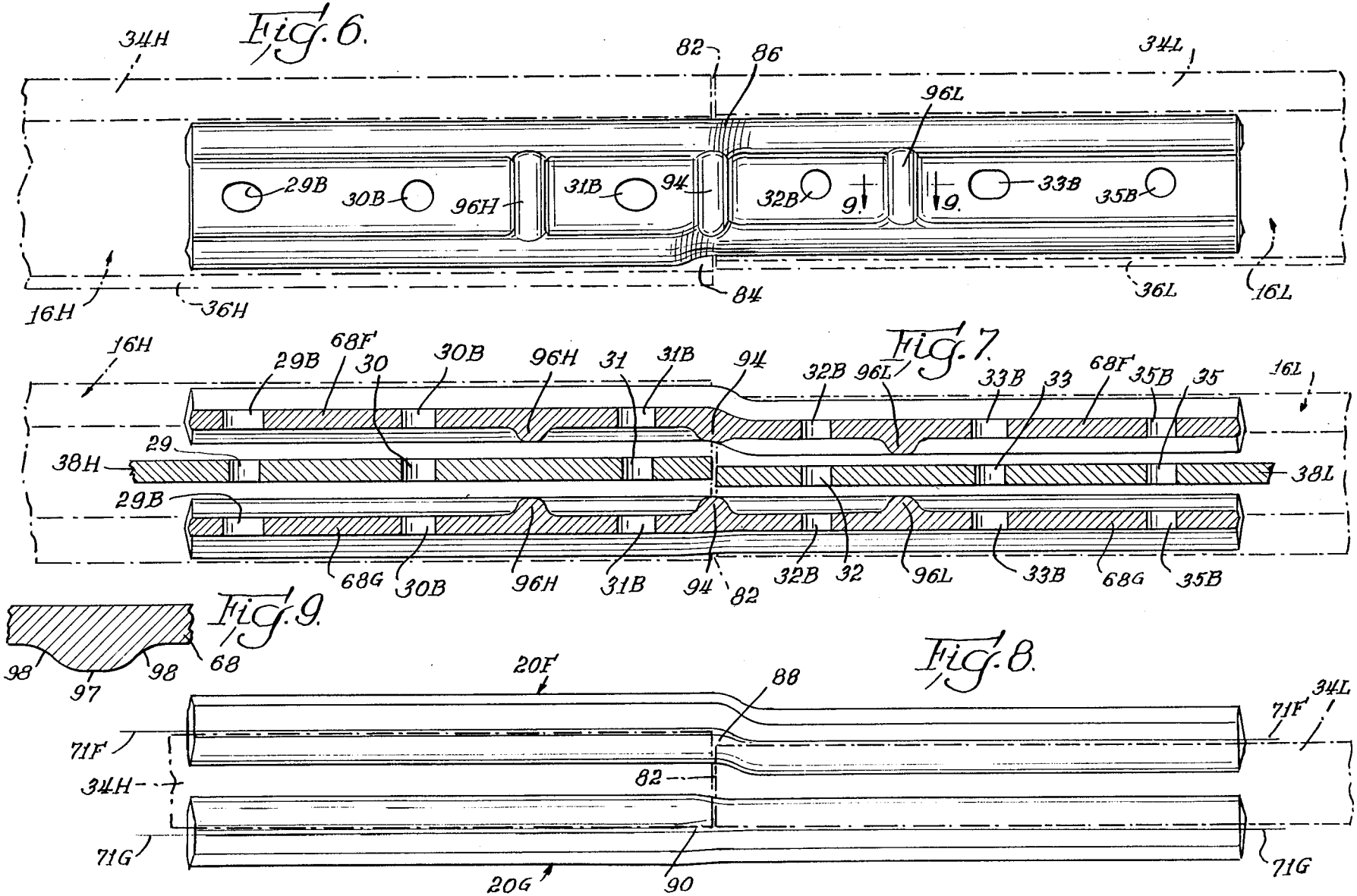
FIG. 6 is a side elevational view of the field side bar of the joint, as seen from the rail side of the bar, and showing the rails in phantom.
FIG. 7 is a downwardly looking sectional view, as seen generally from the bolt holes, of a joint formed with the bar of FIG. 6 and with another bar (but with the fastening means not shown for clarity of disclosure).
FIG. 8 is a top plan view of the joint of FIG. 7, with the rails shown in phantom.
FIG. 9 is an enlarged sectional view, as seen generally from line 9—9 in FIG. 6.

Three holes (see FIG. 7) 29, 30 and 31 are illustrated on the end of the heavier rail 16H; three holes 32, 33 and 35 are illustrated on the end of the lighter rail 16L; and the bar has corresponding holes 29B, 30B, 31B, 33B and 35B. Normally, the bolt holes in the rails are circular; while the bolt holes in the bars may be circular, oval or elliptical. For shorter bars, there may be two holes in the bar end, for connection to each rail. As illustrated in FIG. 2, the bolts may alternately be put through adjacent sets of aligned holes from the gauge side of the rail, and from the field side of the rail.

Although the rails 16H and 16L are dissimilar, they have many similar features. Each rail is elongated, with a uniform cross section (see FIGS. 3, 4 and 5) having a head 34H, 34L; a base 36H, 36L; and a web 38H, 38L extending between the head and base. The head has a slightly crowned top running surface 42H, 42L; side surfaces 44H, 44L extended transverse to the top surface; and angled generally flat under surfaces 46H, 46L extended inwardly from the side surfaces toward the web. The rails 16H, 16L may have convex corners 48H, 48L between the top and side surfaces and between the side and under surfaces; and concave head/web fillets 50H, 50L between the under surfaces of the head and the web. The base 36H, 36L has a generally flat bottom surface 52H, 52L; generally flat angled upper surfaces 54H, 54L extended downwardly away from the web; and concave web/base fillets 56H, 56L between the web and upper base surfaces. The rail web 38H, 38L typically will be normal to the base surface 52H, 52L; and the rail 16H, 16L will be symmetrical of a plane through the center of the web.

Each bar 20F, 20G may have, as illustrated in cross section in FIGS. 3, 4 and 5, enlarged top and bottom portions 64F, 64G and 66F, 66G that are connected together by web portion 68F, 68G. Each of the bars 20F, 20G (see FIG. 4) also has a rail side 70F, 70G and a remote side 72F, 72G, meeting at parting lines 71F, 71G and 73F, 73G in the top and bottom portions and extended along the full length of the bar. The rail side 70F, 70G of each bar 20F, 20G is adapted to lie next to the rail, and specific contact faces are formed on the top and bottom portions of such rail side, to cooperate with specific surfaces of the rail.

Specifically, lower generally flat face 74H, 74L (the H and L suffix referencing cooperation relative to the heavy or light rail) may be formed on the bottom bar portion, adapted to cooperate with upper generally flat base surface 54H, 54L of the rails; and upper generally flat face 76H, 76L and upper convex corner 80H, 80L may be formed on the top bar portion, adapted to cooperate with portions of the generally flat under surface 46H, 46L and concave head fillet 50H, 50L of the rails. Under certain rail-bar cooperations, as will be pointed out later, either the upper flat face 76H, 76L or the upper convex corner 80H, 80L may be eliminated, and the sole contact may then occur across the remaining face.

The formed contact faces 74H, 74L; 76H, 76L; and 80H, 80L on each bar extend axially along the length of the bar, at each bar end, and are shaped specifically to cooperate flush against the adjacent respective rail end of the heavy or light rail, for most of the overlap between these components.

With the dissimilar rails 16H, 16L illustrated in the figures, the rail base surfaces 52H, 52L may be vertically offset, when the rail running surfaces 42H, 42L are aligned. Also, the rail webs 38H, 38L and rail under surfaces 46H, 46L are laterally offset, when the guage side surfaces 44H, 44L are aligned. The contact faces 74H, 74L; 76H, 76L; and 80H, 80L at each end of the bar may have different configurations and/or may be laterally offset from one another, in order to cooperate flush with the appropriate surfaces of the adjacent rails 16H, 16L.

In the region proximate the interruption or gap 82 (see FIG. 6) between the rails ends, each bar 20F, 20G may undergo rather dramatic transitions as illustrated in FIGS. 2, and 5–8, to blend smoothly between these offset or misaligned contact faces at the opposite bar ends. Thus, rail base surfaces 54H, 54L may be so much offset vertically that the cooperating bar face 74H may curve upwardly away from the rail surface before the end of the heavier rail, to be gapped at 84 off of the heavier rail. The same may be true with respect to the cooperating bar faces against the rail head 34L, which may curve downwardly away from the lighter rail head before the end of the rail, to be gapped at 86 off of the lighter rail. The same may also be true with respect to lateral offsets that must be compensated for, as at gaps 88 and 90 illustrated in FIG. 8.

FIGS. 3 and 4 illustrate variations of how the bar contact faces may cooperate with the rail head region. FIG. 3 illustrates a full head contact, where major portions of the flat bar contact face 76H abut the rail under surface 46H, and not much, if any, of the convex faces 80H are against the rail. FIG. 4 illustrates a head free contact, where a portion of the bar slopes away from the rail under surface 46L to leave a gap 92 between these components at the side of the rail; and where the flat bar face 76L may be very small. A single bar may cooperate differently with the different rails, as illustrated having a head free contact against lighter rail 16L and a head full contact against the heavier rail 16H. These contact variations are illustrated only to show the importance of a proper bar fit, needed to minimize stress concentrations within the separate bar, rail and fastening components, upon the bars being tightly clamped and upon a train rolling over the bar joint 18.

The bar and rail components may be intended to cooperate with one another only in the regions generally across the bar faces 74H, 74L; 76H, 76L; and 80H, 80L; and the rail webs 38H, 38L, and bar webs 68F, 68G may remain spaced apart.

One major improvement of this invention relates to the manner of making each connection bar, by forging a billet in a drop or hammer forge between a set of two dies 100, 102, shown in FIG. 10. The schematic representation of FIG. 10 illustrates the motion of top die 100 against a bottom die 102 in the direction of the arrow. The bottom die 102 would have contoured die faces shaped to complement and shape thereby, the rail side (70G or 70F) of the bar; while the other die 100 would have contoured die faces to complement and shape thereby, the remote side (72G or 72F) of the bar. The die faces of each rail side die, at the opposite ends of the bar, would be shaped the same as those rail surfaces that the bar is to fit against, to define the contact faces in the region of the rail head and rail base for each rail; and between these ends, would be shaped for defining the transition region of the bar between the rail ends. The die faces of the remote side die would also be shaped for defining the transition region between the bar ends.

The set of dies will be supported in a conventional large drop or hammer forging apparatus, to move the top die 100 vertically downward at a relatively high velocity, until impact against an interposed billet of steel (not shown) and the other die 102. Appropriate guidance means in the forging apparatus accurately position the dies as they approach and ultimately strike the interpositioned steel and/or one another. The top die and hammer may drop only by gravity, or may be additionally driven by an air piston or the like.

The bottom die 102 of one set of dies is illustrated in a top plan view in FIG. 11. The die surface 106 of die 102 has four forging stations 108, 110, 112 and 114. The forging process will be discussed in relation to the die surface 106 which forms the rail side of the bar. The top die 100 shapes the remote side of the bars. The dies 100 and 102 will form two of the set of four compromise bars and another set of dies (not shown) will form the other two bars of a four bar set.

The steel billet may start in any shape, precut to the approximate length of the bar to be formed, taking into consideration appropriate allowances needed for axial draw. The billet will be heated in a furnace (typically gas-fired or electric) to preheat forging temperatures.

The billet is then subjected to several high velocity strikes between the dies 100, 102 at a draw station 108 initially reshaping the billet into the generally flattened shape of the bar having the enlarged top and bottom portions, and ultimately conforming it to the exact configuration of the connection bar itself.

The contoured die faces typically are made up of several separate forming stations, e.g. stations 108, 110, 112 and 114 spaced apart along the die surface 106. Thus, a draw station may be provided to begin shaping the billet, an optional flattener station (not shown in FIG. 11) may be provided to distribute the billet material where it will be needed, a blocker station 110 may be provided to give the definition of the bar shape, and a finisher station 112 or 114 will be provided having the configuration needed for the bar itself.

Four sets of dies normally would be needed to make the four bars: the right and left gauge side bars 20G, and the right and left field side bars 20F. Because of the similarity between the left gauge side bar and the right field side bar, and between the right gauge side bar and the left field side bar, it is contemplated that these bars, paired up at mentioned, may be made with the same die set. To do this, each die set will have two finisher stations of contoured faces: one finisher station of one die set will be used to make the left gauge side bar, and the other finisher station of the same die set will be used to make the right field side bar; and one finisher station, for example, station 112, of the other die set, for example, dies 100 and 102, will be used to make the right gauge side bar, and the other finisher station 114 of the same die set will be used to make the left field side bar.

When such dies are operated in a forging apparatus, it will be possible to form the contact faces 74H, 74L; 76H, 76L; and 80H, 80L on both the gauge and field side bars very accurately. For example, referring to FIGS. 11 and 12, dies 100 and 102 are brought together to form a left field side bar 20F. The parting lines 71F, 71G and 73F, 73G between the rail sides 70G and 72G and remote sides 70F and 72F of the bar designated PL in FIG. 12, will represent the regions between where the dies approach and may actually contact one another during the forging strikes. Excess material flashing along the parting line between the dies and into a flashing overflow receptacle 116, is a conventional forging technique. The flashing formed in the receptacle 116, may be trimmed away in the forge apparatus; and/or afterwards in a separate operation, but while the piece is still hot.

After the bar has been shaped between the dies, and while still hot, the bolt holes may be hot punches therein. Thereafter, the bar will be oil quenched and tempered; shot blasted for scale; and inspected for tolerance. Tighter control of tolerances of the finished piece is made possible by striking it between restrike dies; generally cold, but sometimes reheated somewhat. After tolerance testing, the bar may be further scaled and tested, such as a tension/compression test; or may be optically scanned (by Magnaflux like equipment) checking for material flaws, or the like.

Several advantages obtained by using the drop or hammer forging technique for manufacturing the bar, some of which are not readily apparent, include: the wide selection of billet materials available for forming the bar; the reduction of residual internal stresses in the bar; the fact that the forged bar need not be machined; and the fact that the forged bar will have very close tolerances.

Thus, as the initial steel billet may be of any shape, including standard cylindrical bar stock; and as all grades of steel come in such bar stocks, any steel may be selected, including high carbon steels, to suit the specific bar needs. This is contrasted against the standard joint bars, or the conventional compromise bars reformed from the standard joint bars, which are available from the specialist bar fabricator only in medium carbon steel, hot rolled to the original joint bar configuration. The wide choice of available steels then provides for a wide selection of quenching and tempering rates, including a slow quench with oil; while still yielding Brinell hardnesses well above railroad specifications, and without developing brittleness or surface stress-cracks. This again is contrasted against standard hot rolled joint bars and/or compromise bars reformed from such hot rolled joint bars (each being of lower carbon steel), that need more rapid quenching, such as water, for generating Brinell hardnesses that satisfy railroad specifications. However, rapid quenching makes the bar more brittle, and susceptible to surface stress-cracks. The forged joint or compromise bar, forged directly from a steel billet, provides only one stage of fabrication, to reduce residual internal stresses. Again, this is contrasted against the mechanical reformation of standard hot rolled bar stock, to the configuration of the compromise bar, whereby residual internal stresses may be generated by such reformation.

Also, the state of the art drop forging techniques allow for establishing, and maintaining tolerances measured in thousandths of an inch throughout the bar configuration, including the contour of each contact face and the alignment or offset between such contact faces; and without subsequent machining. By contrast, such tolerances cannot be achieved or maintained with respect to joint bars formed from a mill rolled product directly, and/or compromise bars compression reformed from such a product.

Another significant improvement of this invention is the formation of a reinforcing rib 94 on the bar web extended across the bar, between and transverse to the enlarged top and bottom portions. The rib 94 may be located on the bar between the first set of holes, 31B and 32B, in from each rail end; and moreover may be adapted when the bar is secured to the rails to line up adjacent and opposite the gap 82 between the rail ends. The rib 94 may be sufficiently wide to bridge this gap 82 between the rail ends and to overlap a short length of each rail.

Other reinforcing ribs 96H and 96L are also illustrated on the bar web, extended across the bar transverse to and between the top and bottom portions. One rib 96H is located on the bar between the first and second sets of holes, 31B and 30B in from the end of the heavier rail 16H; and another rib 96L is located on the bar between the first and second sets of holes, 32B and 33B in from the end of the lighter rail 16L.

Each of the ribs 94, 96H, 96L (see FIG. 9) has an intermediate portion 97 of generally convex curvature, and concave fillets 98 blending between this intermediate portion 97 and the flat adjacent face of the bar web 68G, 68F. In the illustrated embodiment, the reinforcing ribs is located on the rail side 70F, 70G of the bar, adapted to be adjacent the rail web 38H, 38L; but the reinforcing ribs typically will be spaced from the rail web, even as the bars are clamped against the rails. Each reinforcing rib can be integral with the bar web, and can be forged within with its orientation transverse to the length of the bar.

The reinforcing ribs 94, 96H and 96L, connected between the enlarged top and bottom portions, box these portions together for added strength and rigidity, across the transition region between the bar ends and between the first bolt holes in from the rail ends.

This invention may be used in compromise joint bars for connecting any combinations of adjacent rails. There are too many rail combinations to list, but some very common combinations might be for cooperating with the rail stocks of 136 R.E. and 115 R.E.; 132 R.E. and 115 R.E.; 132 R.E. and 131 R.E.; 133 R.E. and 115 R.E.; and 115 R.E. and 90 R.E. This invention may also be used in regular joint bars, for connecting adjacent rails of similar weight and size and having identical cross sections, or in bridging bars or straps used across some welded connections between the rail ends.

Although the invention has been described with respect to the illustrated embodiment, it should be understood that the invention is not limited to that embodiment. Modifications and/or additions may be included by those skilled in the art without department from the scope of the invention as defined by the claims.

What is claimed is:

1. A method of forging a bar for overlapping and connecting the ends of aligned railroad rails disposed in end-to-end relation, said bar being elongate and of finite length, including a rail side and a remote side, said bar including an enlarged top portion having a contacting face on said rail side extending axially along the length of said bar for contacting a rail, an enlarged bottom portion having a contacting face on said rail side extending axially along the length of said bar for contacting a portion of a rail in spaced relation to said contacting face on said top portion, and a connecting web portion, said method comprising the steps of:

providing a pair of dies which are shaped to define the final shape of the bar, including its finite length and respectively the entire rail side and remote side of the intended bar, one of said dies having a forming face conforming to the shape of the entire rail side of the bar and the other of said die having a forming face conforming to the shape of the entire remote side of the bar, providing a billet of metal to be formed into said bar, said billet being devoid of any shape corresponding to the final configuration of said bar locating said billet between the die faces and moving at least one of the die faces repeatedly toward the other at a relatively high velocity for a number of successive strikes against the billet to simultaneously form the enlarged top portion and its contacting face, the enlarged bottom portion and its contacting face, the finite length, and the connecting web portion of the bar.

2. The method of claim 1 wherein the rails to be joined are of different sizes and the bar is divided longitudinally into a first portion and a second portion joined by a centrally transition portion, said first portion being sized for attachment to one rail and said second portion being sized for attachment to the other rail, said die faces including portions which define the shape of said first and said second and said transition portions of the bar, said method further including simultaneously forming said billet to define said first portion, said second portion, and said transition portion of said bar.

3. The method of claim 2 wherein said web portion is of uniform cross-section throughout the length of the bar, said method further including simultaneously forming said billet to define a web portion of uniform cross-section throughout the length of said bar.

4. A method as claimed in claim 1, wherein such material is a high carbon steel and the billet is originally of a cylindrical shape, and wherein the quenching of the forged bar is in oil.

5. A method as claimed in claim 1 including punching holes in the heated bar suited to receive fastening means for connecting to the rails and then quenching the bar.

6. A method as claimed in claim 5, wherein said forming step further includes forming contoured faces on the rail side of the bar, simultaneously with forming said top and bottom contact faces, and simultaneously forming a reinforcing rib raised from the elongated web portion and extended transverse to and between said top and bottom contact faces at a location approximately midway between the length of the bar and intermediate of the holes for the fastening means.

7. A method as claimed in claim 6, wherein said forming step further includes forming contoured faces on the rail side of the bar and simultaneously forming other reinforcing ribs raised from the elongated web portion and extended transverse to and between the top and bottom contact faces at locations spaced axially from the first mentioned rib and from the holes for the fastening means.

8. A method as claimed in claim 7, wherein said forming step further includes forming contoured faces on said rail side of the bar having other reinforcing ribs each with an exterior convex curvature and concave fillets blended between said rib and said web portion.

9. A method as claimed in claim 8, wherein said forming step further includes forming a billet comprising high carbon steel and originally having a cylindrical shape.

10. A method as claimed in claim 5 wherein said forming step further includes forming contoured faces on the rail side of the bar simultaneously with forming said top and bottom contact faces, and simultaneously forming a reinforcing rib raised from the elongated web portion and extended transverse to and between said top and bottom contact faces at a location approximately midway between the length of the bar and intermediate of the holes for the fastening means.

11. A method as claimed in claim 5 wherein the forming step includes forming axially nonaligned contact faces on opposite ends of said bar to cooperate flush against dissimilar rails connected together by the bar, wherein the faces of the rail side die are accordingly nonaligned axially of one another.

12. A method as claimed in claim 11, wherein the forming step further includes forming contoured faces on said bar having a reinforcing rib on the rail side of the bar, simultaneously upon reforming the billet to the bar, said rib being extended transverse to and between the top and bottom portions of the bar and intermediate of the holes for the fastening means.

13. A method as claimed in claim 12 wherein the forming step further includes forming other contoured faces on the rail side of the bar providing other reinforcing ribs on the rail side of the bar, simultaneously upon reforming the billet to the bar, said ribs being extended transverse to and between the top and bottom portions of the bar and at locations spaced axially from the first mentioned rib.

14. A method as claimed in claim 12, wherein said forming step further includes forming contoured faces on the rail side of the bar that extend generally axially and laterally of the bar and that blend smoothly between the corresponding faces on the opposite bar ends, effective to define a transition region on the bar between the bar contact faces.

15. A method of forging a bar for overlapping and connecting the ends of aligned railroad rails disposed in end-to-end relation, having a rail side, a remote side and a finite length formed by the steps of:

providing a pair of dies which are shaped to define respectively the entire rail side and remote side of the intended bar, one of said dies having a forming face conforming to the shape of the entire rail side of the bar and the other of said die having a forming face conforming to the shape of the entire remote side of the bar, providing a billet of metal to be formed into said bar, locating said billet between the die faces and moving at least one of the die faces repeatedly toward the other at a relatively high velocity for a number of successive strikes against the billet to simultaneously form the shape of the bar and its finite length.

16. A bar of claim 15 wherein the rails to be joined are of different sizes and the bar includes a first portion for attachment to one rail and a second portion for attachment to the other rail, with said first portion sized to mate with its associated rail and said second portion sized to mate with its associated rail, said die faces including portions which define the shape of both said first and said second portions of the bar.

* * * * *